US010364541B2

(12) United States Patent
Belder et al.

(10) Patent No.: US 10,364,541 B2
(45) Date of Patent: Jul. 30, 2019

(54) TEMPORARILY COUPLING BETWEEN JACKET AND PILE AND METHOD OF COUPLING

(71) Applicant: IHC Holland IE B.V., Sliedrecht (NL)

(72) Inventors: Cornelis Belder, Oudewater (NL); Cornelis Joannes Kerkvliet, Alphen aan den Rijn (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/527,726

(22) PCT Filed: Nov. 25, 2015

(86) PCT No.: PCT/NL2015/050826
§ 371 (c)(1),
(2) Date: May 18, 2017

(87) PCT Pub. No.: WO2016/085339
PCT Pub. Date: Jun. 2, 2016

(65) Prior Publication Data

US 2017/0356151 A1 Dec. 14, 2017

(30) Foreign Application Priority Data

Nov. 27, 2014 (NL) ..... 2013886

(51) Int. Cl.
*E02D 27/16* (2006.01)
*E02B 17/00* (2006.01)
(Continued)

(52) U.S. Cl.
CPC ..... *E02B 17/0008* (2013.01); *E02B 17/027* (2013.01); *E02B 17/04* (2013.01);
(Continued)

(58) Field of Classification Search
CPC ..... E02B 17/0008
(Continued)

(56) References Cited

U.S. PATENT DOCUMENTS 4,412,759 A * 11/1983 Britton ..... E02B 17/0008 405/205
5,333,916 A * 8/1994 Burkit ..... F16L 17/10 138/99
(Continued)

FOREIGN PATENT DOCUMENTS

CN 203238651 * 10/2013
CN 203238651 U 10/2013
(Continued)

*Primary Examiner* — Sean D Andrish
(74) *Attorney, Agent, or Firm* — N.V. Nederlandsch Octrooibureau; Catherine A. Shultz; Tamara C. Stegmann

(57) ABSTRACT

A method and apparatus for coupling a jacket with a foundation pile, comprising mounting a first flange with the jacket, contacting a second flange with the foundation pile such that the second flange is supported by the foundation pile, mutually positioning the first flange and the second flange such that the jacket may be supported by the pile through the first flange and the second flange, arranging an inflatable spacing member between the first flange and second flange such that the spacing member contacts both the first flange and second flange for supporting the jacket through the spacing member and inflating the spacing member for increasing a spacing between the first flange and second flange.

7 Claims, 4 Drawing Sheets

(51) Int. Cl.
*E02B 17/02* (2006.01)
*E02B 17/04* (2006.01)

(52) U.S. Cl.
CPC . *E02B 2017/006* (2013.01); *E02B 2017/0039* (2013.01); *E02B 2017/0073* (2013.01)

(58) Field of Classification Search
USPC ..... 405/225
See application file for complete search history.

(56) References Cited

U.S. PATENT DOCUMENTS

2013/0149039 A1* 6/2013 Haugsoen ..... E02B 17/0008 405/223
2015/0125220 A1* 5/2015 Glukhovskoy ..... E02B 17/027 405/227

FOREIGN PATENT DOCUMENTS

| | | | | |
|---|---|---|---|---|
| CN | 103437372 | A | | 12/2013 |
| EP | 0104795 | A2 | | 4/1984 |
| GB | 1544842 | A | | 4/1979 |
| GB | 2006910 | A | | 5/1979 |
| GB | 2006910 | | * | 5/1982 |
| JP | 0411125 | A | | 1/1992 |
| NL | 2005542 | C | | 4/2012 |

* cited by examiner

TEMPORARILY COUPLING BETWEEN JACKET AND PILE AND METHOD OF COUPLING

BACKGROUND

The present invention relates to a method for coupling a jacket with a foundation pile, and a coupling system for temporarily coupling a jacket with a foundation pile.

A jacket is a steel structure placed on the seabed for supporting another structure like a platform or windmill. One or more foundation piles have been installed in a, usually, vertical stance in a body of ground, like the bottom of the sea. To level the platform there is a need to adjust one or more corners of a jacket in height. Therefore the jacket is initially movable with respect to a foundation pile. When placing offshore jackets on pre-installed foundation piles, a temporary connection needs to be made which allows for curing of a grout connection between the jacket legs and the foundation piles.

WO2012053892 discloses a clamping device for temporarily coupling a sleeve of a jacket with a pile accommodated in said sleeve. The clamping device is used during offshore installation of a jacket. The clamping device comprises a number of clamping shoes for engagement with the pile such that the pile is coupled within the sleeve, a frame for arranging said number of clamping shoes around the pile, wherein the clamping shoes are moveable between a first position for accommodating said pile in said sleeve and a second position for coupling the pile with said sleeve, an actuating system operationally coupled with the frame and the number of clamping shoes for driving the clamping shoes from the first position to the second position, wherein the actuating system comprises a single actuator operationally coupled with two or more clamping shoes. After the jacket has been positioned, the clamping device couples the pile with the sleeve for temporarily maintaining the position of the jacket. Subsequently, the sleeve and the pile are fixedly coupled in a known manner by means of grout. When the grout is cured, said grout couples the pile and the sleeve for supporting the platform. This known clamping device assumes that the foundation piles are positioned such that leveling of the jacket is not required, or done otherwise.

From GB2006910A it is known to connect pile members by mortar contained in a gap between the pile members and a sleeve. The mortar is contained in the gap by use of inflated tubular seals. In GB2006910A there is no adjustment of the mutual position of the pile members.

GB 1 544 842 A relates to a jacking assembly for moving a load in steps. The assembly has two parts adapted to be slidably mounted at axially spaced positions on the elongate member; and pawl devices mounted on each of said parts and engageable with the elongate member in a way which permits relative axial movement. Therefore, GB 1 544 842 does not deal with coupling of flanges of foundation piles and a jacket.

CN103437372 relates to a grout coupling and has for its purpose to overcome the shortcomings of traditional offshore platform grouting process. Therefore, CN103437372 proposes a procedure for filling a grout cavity. CN103437372 does not suggest to adjust any height position after the foundation pile jacket and subsea connection structure contact.

SUMMARY OF THE INVENTION

The invention aims to provide a temporarily coupling system that enables leveling of the jacket.

The invention aims to provide a coupling system that solves at least partially a problem associated with known clamping devices.

Yet another object of the invention is to provide an alternative coupling system.

According to a first aspect of the invention this is realized with a method for coupling a jacket with a foundation pile, comprising;

- mounting a first flange with the jacket,
- contacting a second flange with the foundation pile such that the second flange is supported by the foundation pile,
- mutually positioning the first flange and the second flange such that the jacket may be supported by the pile through the first flange and the second flange,
- arranging an inflatable spacing member between the first flange and second flange such that the spacing member contacts both the first flange and second flange for supporting the jacket through the spacing member.

The inflatable spacing member enables the adjustment of the height position and levelling of the jacket. In addition, the inflatable spacing member enables the removal of an established coupling in a simple manner without requiring access to the coupling system. In this manner, after the grout connection is cured, the coupling is easily removed in order to assure that loads are transferred through the grout connection and not through a metallic contact between the jacket and the pile. This is beneficial since sub-sea removal of such a coupling system is very cumbersome and safety critical. This is even more important when large numbers of coupling systems are used in e.g. a windmill park.

The inflatable spacing member expands through inflation. The inflatable spacing member is filled with any suitable liquid or gas under pressure so that the inflatable spacing member becomes distended. In view of the considerable weight of a jacket, inflation with a liquid like oil or water is preferred. Since the inflatable spacing member is inflated, or in other words pressurized, through e.g. the oil or water, the inflatable spacing member raises or escalates the jacket.

It is conceivable that the inflatable spacing member is arranged between the first flange and second flange in an inflated, or partly inflated, state.

Contacting a second flange with the foundation pile such that the second flange is supported by the foundation pile allows the use of a standard foundation pile. It will be apparent that the second flange may be mounted with the foundation pile.

In an embodiment, the method comprises inflating the spacing member for increasing a spacing (s) between the first flange and second flange. This inflating provides the levelling of the jacket.

In an embodiment, the method comprises providing a grout coupling between the pile and the jacket.

In an embodiment, the method comprises deflating the spacing member for detaching the spacing member from at least one of the first flange and second flange such that the spacing member no longer supports the jacket. This way, it is assured that loads are transferred through the grout connection only.

In an embodiment, the method comprises inflating the spacing member to such an extent that the spacing member ruptures for detaching the spacing member from at least one of the first flange and second flange such that the spacing member no longer supports the jacket. This is an alternative way of assuring that loads are transferred through the grout connection only.

In an embodiment of the method, the jacket comprises a pin pile facing the foundation pile, the first flange is mounted with the pin pile, and the method comprises accommodating at least a part of the pin pile in the interior of the foundation pile.

In an embodiment of the method, the jacket comprises a sleeve facing the foundation pile, the first flange is mounted in the interior of the sleeve, and the method comprises accommodating at least a part of the foundation pile in the interior of the sleeve.

In an embodiment, the method comprises coupling the first and second flanges such that the first and second flanges move in unity when contacting the foundation pile through the second flange. This way standard foundation piles can be used with the coupling system according to the invention.

The invention therefore further provides a coupling system for temporarily coupling a jacket with a foundation pile, the coupling system comprising;

a first flange for mounting with the jacket, a second flange for contacting the foundation pile, an inflatable spacing member arranged between the first flange and second flange, which inflatable spacing member contacts both the first flange and second flange for supporting the jacket through the spacing member.

In an embodiment of the coupling system, at least one of the first flange and second flange is annular, preferably both of the first flange and second flange are annular. It will be clear that the flange does not necessarily form a closed ring. The use of sections is conceivable.

In an embodiment of the coupling system, the spacing member is annular. This enables the support of the jacket, or leg of a jacket in an even way around the circumference of the jacket or leg of a jacket.

In an embodiment of the coupling system, the spacing member comprises an annular pressure chamber for inflating the spacing member. This enables a uniform load of the first flange and second flange, and an even lifting of the jacket. The spacing member may have one or more annular pressure chamber as desired.

In an embodiment of the coupling system, the spacing member comprises a rupture zone having a reduced strength to provide a predictable way of rupturing.

In an embodiment, the coupling system comprises an auxiliary spacing member, arranged between the first flange and second flange, to guarantee a minimal spacing between the first flange and second flange such that inflating of the spacing member is facilitated.

In an embodiment of the coupling system, the inflatable spacing member comprises metal, preferably is made of metal.

The invention therefore further provides an assembly of a jacket and a foundation pile coupled by a coupling system according to the invention.

In an embodiment of the assembly, the jacket comprises a pin pile and the first flange is mounted with the pin pile.

In an embodiment of the assembly, the jacket comprises a sleeve and the first flange is mounted in the interior of the sleeve.

According to a further aspect of the invention this is realized with a device comprising one or more of the characterising features described in the description and/or shown in the attached drawings.

According to a further aspect of the invention this is realized with a method comprising one or more of the characterising features described in the description and/or shown in the attached drawings.

The various aspects discussed herein can be combined in order to provide additional advantages.

DESCRIPTION OF THE DRAWINGS

The invention will be further elucidated referring to the schematic drawings wherein shown in.

DETAILED DESCRIPTION OF EMBODIMENTS

Figure 1:
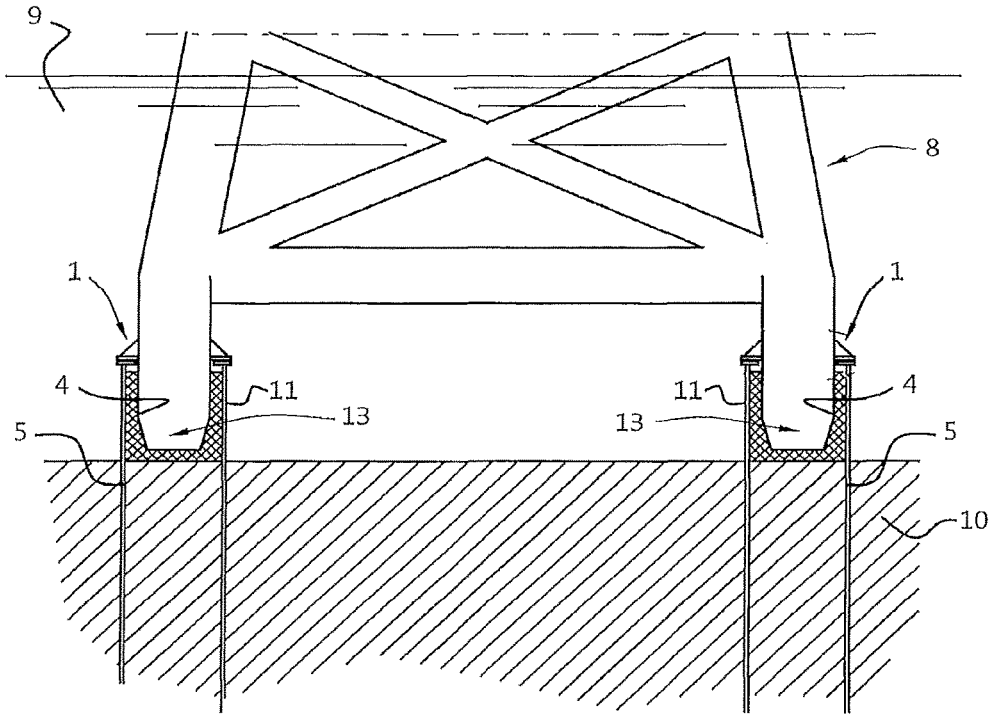
FIG. 1 in side view a jacket coupled with foundation piles through coupling systems according to the invention.
Figure 2A:
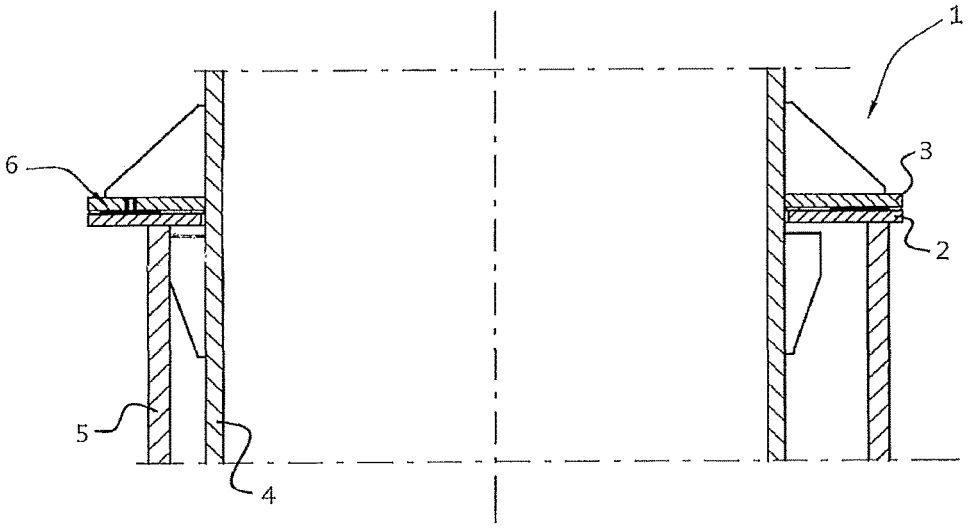
FIGS. 2*a* and 2*b* a detail of FIG. 1.
Figure 2B:
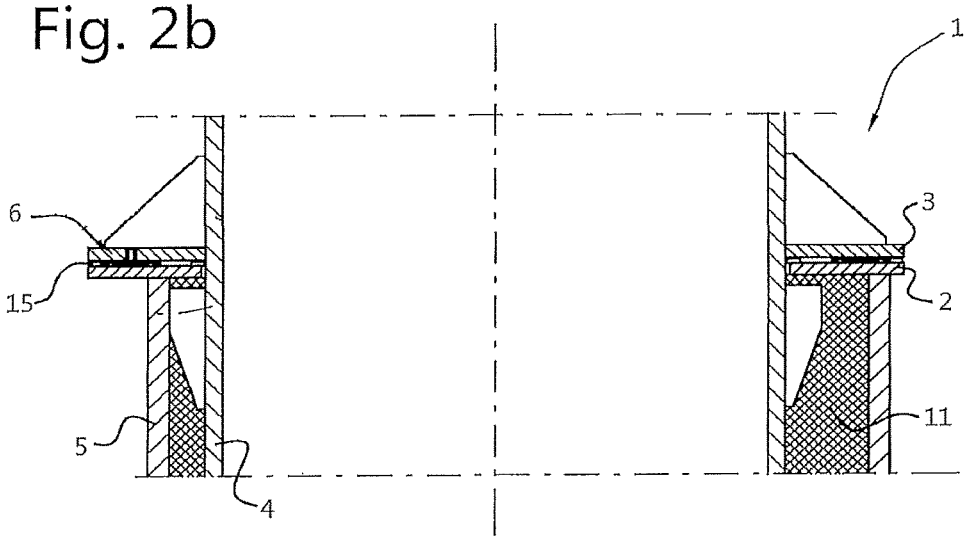

FIG. 1 shows in side view an assembly of a jacket 8 coupled with foundation piles 5 through coupling systems 1 according to the invention. The jacket 8 is partly submerged in a body of water 9. The piles 5 are driven into the bottom 10 of the body of water 9. Here, the jacket 8 comprises a pin pile 13. The first flange 3 is mounted with the pin pile 13 of the jacket 8. The pin pile 13 is accommodated in the interior of the foundation pile 5.

The coupling system 1 is suitable for temporarily coupling a jacket 8 with a foundation pile 5. The coupling system 1 comprises a first flange 3 mounted with the jacket. Here, the first flange 3 is mounted on a wall member 4 of the jacket 8. The first flange 3 is capable to support the jacket 8. The coupling system 1 comprises a second flange 2 for contacting the foundation pile 5. Here, the second flange 2 contacts the top end of the foundation pile 5. It is conceivable that the second flange 2 is mounted with the foundation pile 5. Here, both the first flange 3 and second flange 2 are annular and extend around the pin pile 13.

The coupling system 1 comprises an inflatable spacing member 6. The spacing member is arranged between the first flange 3 and second flange 2. The inflatable spacing member 6 contacts both the first flange 2 and second flange 3 for supporting the jacket through the spacing member. Here, the spacing member 6 is annular, other forms may be conceivable. In this case, the first flange 3, second flange 2 and the inflatable spacing member 6 have a corresponding annular shape.

Figure 3A:
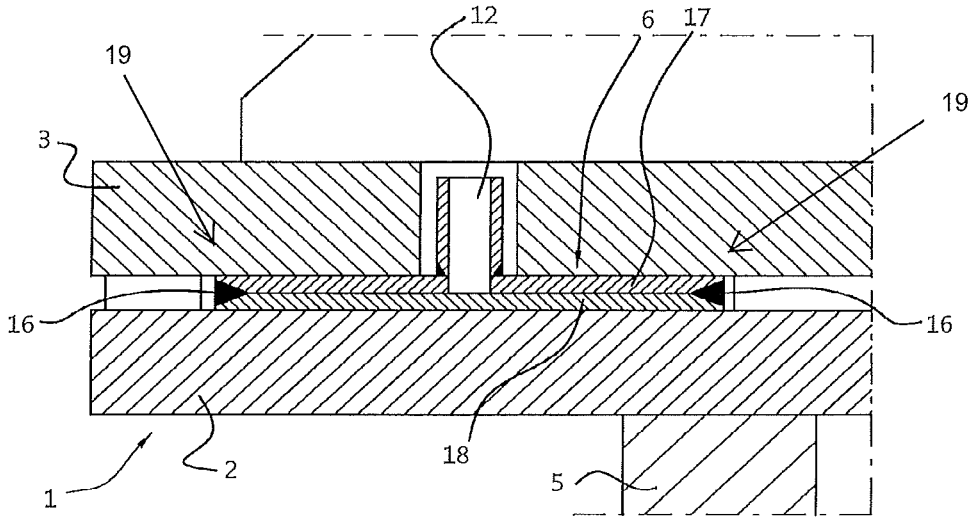
FIGS. 3*a* and 3*b* details of FIGS. 2*a* and 2*b*.
Figure 3B:
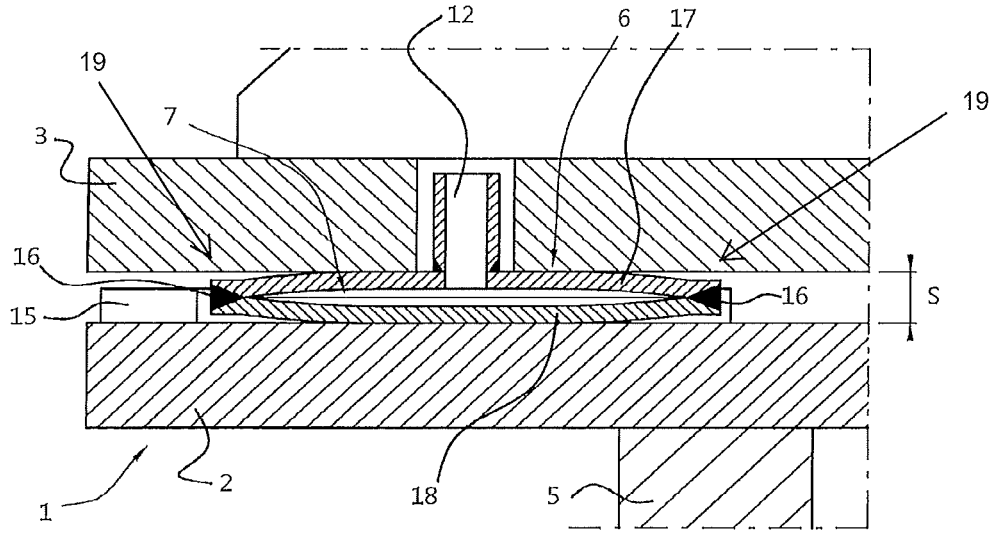

Here, the spacing member 6 has one annular pressure chamber 7 for inflating the spacing member. The inflatable spacing member is made of metal. The spacing member 6 is made of two opposite flat rings. The rings are welded 16 together at their edges and do form the pressure chamber 7. The spacing member 6 is provided with an inlet 12 for introducing a pressurized medium in the pressure chamber 7. When the pressure chamber 7 is pressurized, the plates deform and increase the spacing s between the first flange 3 and the second flange 2 as shown in FIGS. 3*a* and 3*b*. Depending on the dimensions of the spacing member 6, a height adjustment range for the spacing member 6 of between 1 to 30 mm is conceivable.

As an option, the spacing member 6 comprises a rupture zone 19 having a reduced strength to provide a predictable way of rupturing.

In this case, the coupling system 1 comprises an auxiliary spacing member 15. The auxiliary spacing member 15 is arranged between the first flange 3 and second flange 2 in order to guarantee a minimal spacing s between the first flange 3 and second flange 2 such that inflating of the spacing member 6 is facilitated. The auxiliary spacing member 15 may be arranged in the pressure chamber 7 of the spacing member 6.

As shown in FIGS. 3*a* and 3*b*, the inflatable spacing member 6 comprises two opposite metal plates 17, 18 also referred to as ring(s). The plates 17, 18 coupled at their ends through weld beads 16. FIG. 3*a* shows the inflatable spacing member 6 in its initial state. Upon inflating of the spacing member 6 by e.g. injecting a hydraulic medium under high pressure between the plates 17, 18, the plates will deform plastically into a donut-like shape as shown in FIG. 3*b*. As a consequence the jacket 8 will be lifted. In practice the height adjustment range of the coupling system is between 1-30 mm. Subsequently the grout coupling 11 between the pile and the jacket can be established. After the grout is cured, the spacing member 6 can either be de-pressurized or over-pressurized. Such an over-pressurizing causes rupture of the spacing member 6, e.g. at the weld beads 16. Both de-pressurizing or over pressurizing result in losing the ability of the spacing member 6 to transfer any axial loads between the foundation pile 5 and the jacket 8.

Figure 4:
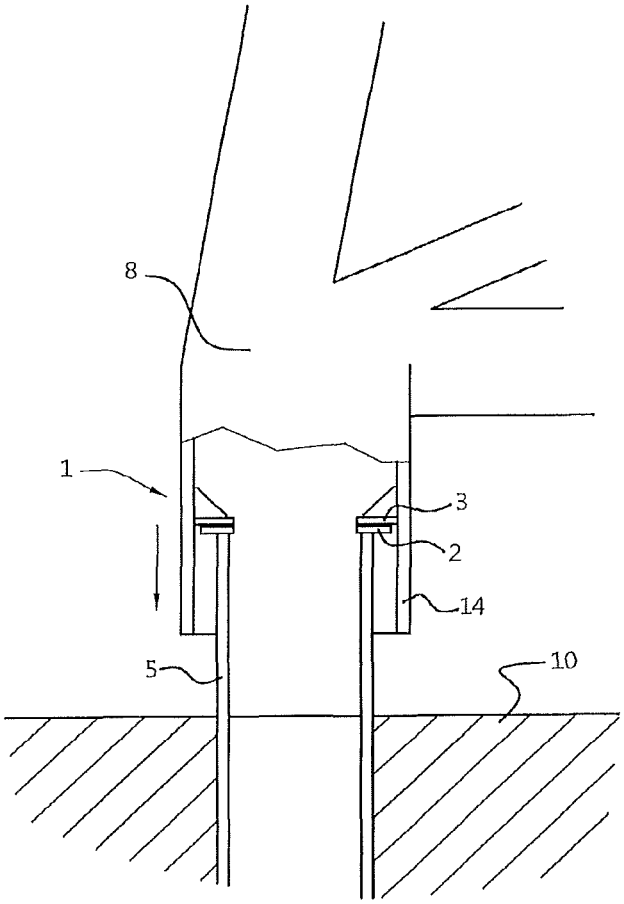
FIG. 4 a side view of a further embodiment of the coupling system according to the invention.

FIG. 4 shows a side view of a further embodiment of the coupling system 1 according to the invention. In this case, the jacket 8 comprises a sleeve 14 and the first flange 3 is mounted in the interior of the sleeve 14. The top end of a foundation pile 5 is accommodated in the sleeve 14.

During use of a coupling system 1 according to the invention for coupling a jacket 8 with a foundation pile 5 the following method steps are executed. The first flange 3 is mounted with the jacket 8. The second flange 2 contacts the foundation pile 5 such that the second flange 2 is supported by the foundation pile 5. The first flange 3 and the second flange are mutually positioned such that the jacket 8 may be supported by the foundation pile 5 through the first flange 3 and the second flange 2. Arranging an inflatable spacing member 6 between the first flange 3 and second flange 2 such that the spacing member contacts both the first flange 3 and second flange 2 for supporting the jacket through the spacing member.

Before establishing a grout connection 11 between the jacket 8 and foundation pile 5, the spacing member 6 is inflated for increasing a spacing s between the first flange 3 and second flange 2. The spacing member 6 is inflated to such an extent that corresponds with a desired height position of the jacket 8. After the jacket 8 has taken its desired position, a grout coupling 11 is established between the foundation pile 5 and the jacket 8.

As an option, after the grout coupling 11 is established between the foundation pile 5 and the jacket 8, the method comprises deflating the spacing member 6 for detaching the spacing member 6 from at least one of the first flange 3 and second flange 2. The spacing member 6 then no longer supports the jacket 8. Instead, the grout coupling supports the jacket 8.

Instead of deflating the spacing member, the method may comprise inflating the spacing member 6 to such an extent that the spacing member ruptures for detaching the spacing member from at least one of the first flange 3 and second flange 2. As will be clear the spacing member 6 then no longer supports the jacket 8.

As shown in FIGS. 1, 2*a*, 2*b*, 3*a* and 3*b*, the jacket 8 comprises a pin pile 13 that faces the foundation pile 5. The first flange 3 is mounted with the pin pile 13. The method then comprises accommodating a lower end of the pin pile 13 in the interior of the foundation pile 5.

As shown in FIG. 4, the jacket 8 may comprise a sleeve 14 that faces the foundation pile 5. The first flange 3 is mounted in the interior of the sleeve 14. The method then comprises accommodating a top end of the foundation pile 5 in the interior of the sleeve 14.

Optionally, the method comprises coupling the first 3 and second 2 flanges such that the first and second flanges move in unity when contacting the foundation pile 5 with the second flange 2.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A method for coupling a jacket with a foundation pile, comprising;

mounting a first flange with the jacket, contacting a second flange with the foundation pile such that the second flange is supported by the foundation pile, mutually positioning the first flange and the second flange such that the jacket is supported by the pile through the first flange and the second flange, arranging an inflatable spacing member between the first flange and second flange such that the spacing member contacts both the first flange and second flange for supporting the jacket through the spacing member;

inflating the spacing member for increasing a spacing between the first flange and second flange; and detaching the spacing member from at least one of the first flange and second flange.

2. The method according to claim 1, comprising providing a grout coupling between the pile and the jacket.

3. The method according to claim 2, comprising deflating the spacing member for detaching the spacing member from at least one of the first flange and second flange such that the spacing member no longer supports the jacket.

4. The method according to claim 2, comprising inflating the spacing member to such an extent that the spacing member ruptures for detaching the spacing member from at least one of the first flange and second flange such that the spacing member no longer supports the jacket.

5. The method according to claim 1, wherein the jacket comprises a pin pile facing the foundation pile, the first flange is mounted with the pin pile, and the method comprises accommodating at least a part of the pin pile in an interior of the foundation pile.

6. The method according to claim 1, wherein, the jacket comprises a sleeve facing the foundation pile, the first flange is mounted in an interior of the sleeve, and the method comprises accommodating at least a part of the foundation pile in the interior of the sleeve.

7. The method according to claim 1, wherein the first and second flanges contact the foundation pile through the second flange; and comprising coupling the first and second flanges such that the first and second flanges move in unity.

* * * * *